United States Patent [19]

Gurioli

[11] 4,164,278

[45] Aug. 14, 1979

[54] CONTINUOUS PUSHER DEVICE FOR CIGARETTE PACKING MACHINES

[75] Inventor: Pasquino Gurioli, Bologna, Italy

[73] Assignee: CIR-S.p.A-Divisione SASIB, Bologna, Italy

[21] Appl. No.: 898,192

[22] Filed: Apr. 20, 1978

[30] Foreign Application Priority Data

May 10, 1977 [IT] Italy ..... 12599 A/77

[51] Int. Cl.[2] ..... B65G 65/42; B65G 19/10

[52] U.S. Cl. ..... 198/487; 198/740

[58] Field of Search ..... 198/487, 430, 740, 429; 53/148, 149, 151; 131/25

[56] References Cited

U.S. PATENT DOCUMENTS

| | | | |
|---|---|---|---|
| 3,301,375 | 1/1967 | Schmermund | 198/487 |
| 3,333,674 | 8/1967 | Homan | 198/487 |
| 3,876,062 | 4/1975 | Honda | 198/732 |
| 4,096,682 | 6/1978 | Sheahan | 53/149 |
| 4,096,938 | 6/1978 | Payne | 198/540 |

FOREIGN PATENT DOCUMENTS

| | | |
|---|---|---|
| 1225100 | 9/1966 | Fed. Rep. of Germany . |
| 1021315 | 3/1966 | United Kingdom . |

OTHER PUBLICATIONS

German Publication of Patent Application No. 2,204,268, Focke et al.

*Primary Examiner*—Robert B. Reeves
*Assistant Examiner*—Brian M. Bond
*Attorney, Agent, or Firm*—Spencer & Kaye

[57] ABSTRACT

In a cigarette packing machine a pusher device for the ejection of cigarette groups formed in a composition chamber from the said composition chamber into a receiving pocket comprises a first continuous endless conveyor provided with pushers mounted thereon, said pushers sequentially engaging the said composition chamber in the direction of the axis of the cigarettes and thus ejecting from the said chamber the formed cigarette group. Each pusher is carried by a supporting rod which is telescopically slidable in a tubular carrier element rotatably mounted on said first conveyor and the telescopically slidable supporting rod is connected through a crank linkage to a second endless conveyor parallel to the said first conveyor, while the tubular carrier element is mounted on a pin rotatable on a support provided on the first conveyor and is connected through another crank linkage a third endless conveyor parallel to the first conveyor. The first conveyor is located forwardly with respect to the other two conveyors, and all the said three conveyors rotate synchronously in the same direction.

3 Claims, 2 Drawing Figures

CONTINUOUS PUSHER DEVICE FOR CIGARETTE PACKING MACHINES

STATEMENT OF THE PRIOR ART

The following prior art is known to the applicant:

British Pat. No. 1,021,315 (ZAVODY V. I. LENINA PLZEN): the whole document;

U.S. Pat. No. 3,876,062 (HONDA): the whole document;

German Publication of Patent Application (OS) No. 2 204 268 (FOCKE & PFUHL): the whole document;

German Pat. Publication (AS) No. 1 225 100 (SCHMERMUND): the whole document.

BACKGROUND AND SUMMARY OF THE INVENTION

This invention relates to cigarette packers in which the cigarette blocks to be packed are composed in the alveolar chamber of a forming hopper and from the said chamber are transferred to respective machine compressor drum pockets, after passing through a cigarette block compacting duct. For this block transfer, use is made of pushers, with pushing elements shaped in conformity with the alveolar chamber, and guided in such a manner as to be compelled to follow an operative path which comprises a straight transfer path section along which the alveolar chamber is aligned with one of the compressor drum pockets through the interposed compacting duct. A pusher device of this type is illustrated, for example, in the pending U.S. application No. 798 557 (ZULLO) filed May 19, 1977.

More particularly, the pusher of this invention belongs to those of the type in which many pushers are mounted equispaced between each other onto an endless conveyor, such as a belt, driven so as to continuously move in one direction. In known devices of this type, the use of cams is required or other equivalent means, possibly in association with springs, to move the pusher, during its return stroke, into a position of complete disengagement with respect to the compressor drum and to the compacting duct. Due to the high working rates of modern packers, the cam systems and the like involve high inertia forces, with all the consequent inconveniences and disadvantages.

The purpose of this invention is to realize a continuous pusher of the above type, particularly adapted for transferring in sequence cigarette blocks from the composition alveolar chamber of the block forming hopper, to the respective pockets of the associated block compressor drum, through the compacting duct of a cigarette packer machine.

Substantially, the device according to the invention consists of a complex driving assembly, with endless flexible means, such as a pair of toothed belts or flat link chains, equal to each other and guided in equal manner in interspaced and parallel vertical planes, with the belts driven at the same level, but horizontally staggered in the direction of their extension, while among these belts there is operatively mounted for each pushing element a corresponding telescopic support, to which there is associated the relative pusher which is thus subjected to a traversing motion in a closed circuit, according to a path having a straight run in line with the said composition alveolar chamber and with the port of the compacting duct of the block being transferred, while an initial section of the "exit" path of each belt of said pair, on the side towards the compressor drum, is so guided as to fall out-of-the-perpendicular in relation to the end of the overlying straight run of the belts; said device comprising also a third endless flexible drive, such as a belt, similar and similarly arranged in relation to those of the above mentioned pair to which it is operatively associated, but having a less marked out-of-the-perpendicular downward run, and located farther back; to this third drive there is articulately coupled the rod of the pushing element of each of the said traversing telescopic supports, in such a manner that, as soon as a pusher has completed its forward stroke which brings a cigarette block into the corresponding compressor drum pocket, the said third belt causes the correlative telescopic support to be oscillated backward, while it is about to begin its descent along the out-of-the-perpendicular runs of the belts which guide it, thus determining the immediate disengagement of the relative pusher from the already pushed block whereby this pusher, as soon as it has introduced the block into the pocket, it is immediately and positively withdrawn from the block head, so as to completely avoid any sliding contact of the pushing element with it.

These and other features of the invention and the resulting advantages will be understood from the following detailed description of a preferred embodiment, made with reference to the attached drawings.

DESCRIPTION OF THE PREFERRED EMBODIMENT

Figure 1:
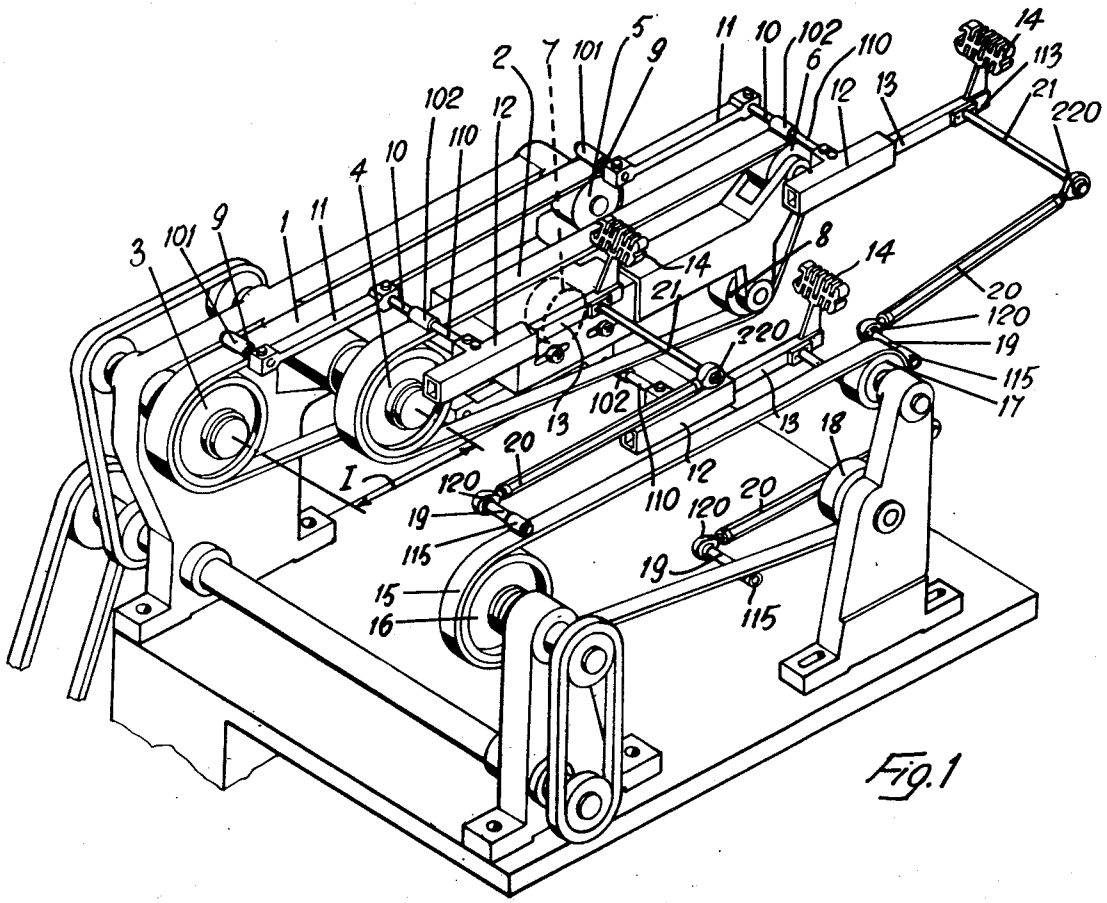
FIG. 1 is a perspective view of a continuous pusher according to the invention.
Figure 2:
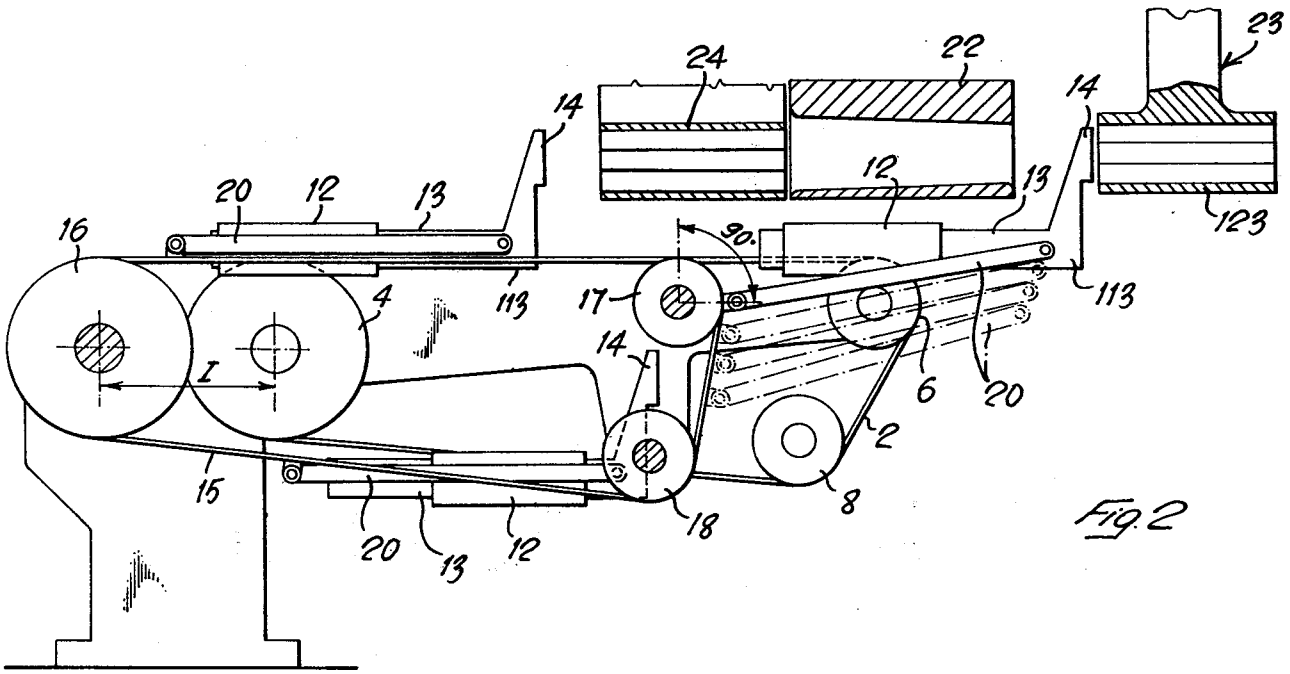
FIG. 2 is a side elevation diagrammatic view of the pusher of FIG. 1.

With reference to the Figures of the drawings, reference numerals 1 and 2 indicate two endless belts, equal to each other, arranged side by side and parallel, but somewhat staggered in the direction of their length.

Belt conveyors 1 and 2 are guided on respective drive pulleys 3, 4, driven by common actuating means (not illustrated) through a drive usually comprising an endless belt transmission. The pair of pulleys 5, 7 and 6, 8 are idle and complete the guiding train for each one of the said belts 1 and 2. The axis of the corresponding pulleys in the two guiding trains, that is, those of pairs 3, 4, 5, 6 and 7, 8 respectively, are not coincident between each other, but distinct, and have a common interdistance I, the value of which corresponds to that of the above staggered relationship.

The respective upper runs of belts 1 and 2 lie in the same horizontal plane. The axis of the pair of driven pulleys 5, 7 and 6, 8 of each belt 1, 2 do not lie in a same vertical plane but in vertical planes parallelly staggered between each other with the axis 7, 8 respectively in a lower position than the corresponding axes of rollers 5 and 6. With this arrangement, each belt 1, 2 from the end towards compressor drum 23, after the upper flat run presents a section falling out-of-the-perpendicular under the run itself, and, consequently, away from said end of the corresponding belt.

Fastened to belts 1 and 2, are, respectively, three pairs of supports 101, 102, regularly equispaced between each other along a closed path of the corresponding belt. Mounted in these supports are pins 9 and 10, interconnected by means of connecting rod 11, whose length is equal to the interdistance I between 1 and 2.

In correspondence of the end 110 of each pin 10 there is fastened a tubular carrier element, or sleeve 12, and the arrangement is such that this sleeve 12 is longitudinally oriented, according to the paths followed by belts 1 and 2. The cavity of sleeve 12 has a polygonal section, for instance, rectangular.

The above constitutes a complex of traversing supports, movable in the manner of an articulated parallelogram. In fact, it is evident that sleeves 12 are guided in a closed circuit, so as to always move parallely to themselves, thus maintaining themselves horizontal during the motion of belts 1 and 2, along the upper flat run and also in any other belt section, including the section falling out-of-the-perpendicular, or exit section. Each sleeve 12 constitutes the outer element of a telescopic rod, of which stem 13 represents the inner element. At the free end 113 of this stem is fastened a pushing element 14.

In association with the above described traversing telescopic assembly for the pushing elements there is provided another endless belt 15, located laterally to belt 2. Belt 15 has a run identical to that of belts 1 and 2, and it presents three hinge supports 115, regularly interspaced along the belt itself. This belt is driven and guided on pulleys 16, 17, 18, the first of which is the driving pulley. This assembly of belt 15 is similar to that of belts 1 and 2, but the inclination with respect to the perpendicular of the downward section from the upper pulley 17 to the lower pulley 18, is less than that of the downward section of belts 1 and 2.

To each support 115 of belt 15 is secured a pin 19, fastened in the ball joint 120 of a tie rod 20. Ball joint 120 is arranged at an end of tie rod 20. At the other end of the same tie rod there is mounted another ball joint 220 for the transverse connecting rod 21, fastened to the stem 13 of a corresponding pusher support, thus realizing a crank linkage.

As already mentioned, the length of belt 15 is equal to that of belts 1 and 2; and, evidently, also the interdistance between supports 115 of belt 15 is equal to the interdistance between supports 101 of belt 1 and between supports 102 of belt 2. However, the three belts 1, 2 and 15 are timed in such a manner that when a support 102 of belt 2 comes to be on the vertical with respect to the axis of rotation of driven pulley 6, the corresponding support 115 is shifted 90° in advance out of phase.

By virtue of this out of phase arrangement, when a pusher 14 has transferred the cigarette from the composition chamber 24 into compacting duct 22 and thence into pocket 123 of compressor drum 23, the motions of telescopic sleeve 12 and of stem 13, sliding in it, are so composed that pusher 14 is quickly moved away from pocket 123, following a trajectory which has a sub-vertical development, and in any case such as to prevent any interference with compressor drum 23 and compacting duct 22.

It is believed that the invention will have been clearly understood from the foregoing detailed description of the preferred embodiment. Changes in the details of construction may be resorted to without departing from the spirit of the invention, and it is accordingly intended that no limitation be implied and that the hereto annexed claims be given the broadest interpretation to which the employed language fairly admits.

I claim:

1. In a cigarette packing machine a pusher device for the ejection of cigarette groups formed in a composition chamber from the said composition chamber into a receiving pocket comprising a first continuous endless conveyor provided with pushers mounted thereon, said pushers sequentially engaging the said composition chamber in the direction of the axis of the cigarette and thus ejecting from the said chamber the formed cigarette group, wherein the improvement consists in that each pusher is carried by a supporting rod which is telescopically slidable in a tubular carrier element rotatably mounted on said first conveyor and that the telescopically slidable supporting rod is connected through a crank linkage to a second endless conveyor parallel to the said first conveyor, while the tubular carrier element is mounted on a pin rotatable on a support provided on the first conveyor and is connected through another crank linkage a third endless conveyor parallel to the first conveyor, the first conveyor being located forwardly with respect to the other two conveyors, all the said three conveyors rotating synchronously and in the same direction.

2. A pusher device according to claim 1, in which the said second endless conveyor which is connected through a crank linkage to the telescopically slidable pusher supporting rod, presents, in correspondence of the cigarette group composition chamber, a downwardly directed section having such an inclination so as to result out of the perpendicular and directed away from the said composition chamber.

3. A pusher device according to claim 1 in which the three endless conveyors present, in correspondence of the cigarette group composition chamber, a downwardly directed section having such an inclination so as to result out of the perpendicular and directed away from the said composition chamber.

* * * * *